US006010470A

United States Patent [19]

Albery et al.

[11] Patent Number: 6,010,470

[45] **Date of Patent: *Jan. 4, 2000**

[54] AUTOMATED RETROGRADE INFLATION CARDIOPULMONARY RESUSCITATION TROUSERS

[75] Inventors: William B. Albery, Spring Valley; Lloyd D. Tripp, Dayton, both of Ohio

[73] Assignee: The United States of America as represented by the Secretary of the Air Force, Washington, D.C.

[ * ] Notice: Under 35 U.S.C. 154(b), the term of this patent shall be extended for 306 days.

[21] Appl. No.: 08/500,278

[22] Filed: Jul. 10, 1995

[51] Int. Cl.[7] ..... A61H 7/00

[52] U.S. Cl. ..... 601/152; 601/151; 601/149

[58] Field of Search ..... 601/41, 43, 44, 601/150, 151, 148, 149, 152

[56] References Cited

U.S. PATENT DOCUMENTS

| | | | |
|---|---|---|---|
| 4,396,010 | 8/1983 | Arkans | 601/152 |
| 4,753,226 | 6/1988 | Zheng et al. | 601/150 |
| 4,928,674 | 5/1990 | Halperin et al. | 601/44 |
| 5,370,603 | 12/1994 | Newman | 601/150 |

*Primary Examiner*—Richard J. Apley
*Assistant Examiner*—Benjamin Koo
*Attorney, Agent, or Firm*—Fredric L. Sinder; Thomas L. Kundert

[57] ABSTRACT

A new portable apparatus and method for sequentially pumping blood headward to assist cardiopulmonary resuscitation (CPR) and other medical procedures is disclosed. A pair of autocycling retrograde inflation trousers comprise calf and thigh encircling air bladders and abdomen covering air bladders connected in pneumatic series so that as the air bladders are filled starting with the furthermost (from the heart) calf encircling air bladders, the bladders sequentially fill to force, or milk, blood headward. The trousers are filled from an adjustable autocycling air pressure regulator connected to a standard fire department self-contained breathing apparatus air bottle. The air pressure regulator adjusts the air pressure between a higher pressure sufficient to force blood flow headward and a lower pressure sufficient to maintain peripheral vascular resistance. The autocycling inflation and deflation controlled by the air pressure regulator aids a heath care provider in timing CPR. A pulmonary face mask can also be made part of the CPR apparatus.

8 Claims, 3 Drawing Sheets

AUTOMATED RETROGRADE INFLATION CARDIOPULMONARY RESUSCITATION TROUSERS

RIGHTS OF THE GOVERNMENT

The invention described herein may be manufactured and used by or for the Government of the United States for all governmental purposes without the payment of any royalty.

BACKGROUND OF THE INVENTION

The present invention relates generally to anti-shock trousers, and more specifically to trousers that sequentially pump blood headward to aid cardiopulmonary resuscitation (CPR) and other medical procedures.

Shock is a state of massive physiological reaction to severe physical or emotional trauma, usually characterized by marked loss of blood pressure and depression of vital processes. Anti-shock trousers apply pressure to the lower body (primarily the abdomen and legs) of an injured person to increase blood return to the heart and to decrease blood perfusion in the lower body. Typical anti-shock trousers for use immediately following trauma, such as Military Anti Shock Trousers (MAST), utilize inflatable bladders to squeeze the legs and abdomen. U.S. Pat. No. 4,577,622 to Jennings teaches an improvement to conventional anti-shock trousers that includes wrapping elastic bands from the ankles to the waist to "milk" blood to the upper body.

Similar to anti-shock trousers are external cardiac assistance apparatus which sequentially fill lower body air bladders to pump blood toward the heart. An example is U.S. Pat. No. 3,866,604 to Curless et al. Also similar to anti-shock trousers are anti-G suits, a number of which include sequential application of pressure through air bladders to force blood flow to continue in the upper body. An example is U.S. Pat. No. 4,583,522 to Aronne. Another example is U.S. Pat. No. 2,495,316 to Clark et al. which, by its bladder arrangement and design, eliminates the need for complicated valving to achieve peristaltic pumping.

A recent advance in emergency treatment is the use of pneumatic CPR garments for enhancing the effectiveness of CPR. These garments synchronize the application of lower body pressure by air bladders with the application of cardiopulmonary resuscitation pressure on the chest. An example is U.S. Pat. No. 5,370,603 to Newman. Newman places a pressure sensor over the chest of an injured subject. The pressure sensor is connected to a valve for a supply of pressurized air such that when pressure is applied to the chest as part of CPR, the valve releases air from the air bladders in a lower body garment and, when pressure is released from the chest, the valve feeds pressurized air to reinflate the air bladders.

Despite these advances in the art of assisting cardiopulmonary resuscitation and the related art of anti-G suits, the prior art has failed to successfully combine the best and most appropriate features from the prior art to make a maximally successful CPR assistance garment. For example, the Newman garment applies pressure from the top down to the lower body creating the risk of blood pooling in the lower body. A particular problem with prior art CPR assistance garments is that they require substantial additional support equipment not normally found as part of paramedic equipment. That and other complexities in their use have limited their acceptance in the field by paramedics and emergency health care personnel.

Thus it is seen that there is still a need for an improved CPR assistance garment, particularly one specifically adapted for advantageous use by paramedics in the field.

It is, therefore, a principal object of the present invention to combine new features with the best and most appropriate features from the prior art to make a novel CPR assistance garment that is simple, compact, easy to use, effective in assisting CPR, and which will be readily accepted by paramedics and other health care workers.

It is a feature of the present invention that it uses a readily available conventional fire department self-contained breathing apparatus air bottle for the pressurized air supply.

It is another feature of the present invention that conventional pulmonary resuscitation face masks can be easily made part of the invention to further improve the CPR assistance effectiveness of the invention.

It is an advantage of the present invention that it produces peristaltic pumping without complicated valving mechanisms.

It is another advantage of the present invention that it is particularly suited for use away from hospitals, such as at battlefields and in the wilderness.

It is yet another advantage of the present invention that it can be used in rehabilitative medicine to provide a variety of rehabilitative therapies.

These and other objects, features and advantages of the present invention will become apparent as the description of certain representative embodiments proceeds.

SUMMARY OF THE INVENTION

The present invention provides a new method for assisting cardiopulmonary resuscitation using autocycling retrograde inflation trousers. The breakthrough discovery of the present invention is that the best combination of features from the various applicable prior art areas comprises combining prior art anti-G retrograde inflation trousers with an autocycling air pressure regulator that cycles between a lower ready pressure sufficient to maintain peripheral vascular resistance and a higher pressure sufficient to enhance blood flow. The cycling rate can be used as a guide for health care personnel applying chest pressure as part of cardiopulmonary resuscitation. Adding a pulmonary resuscitation face mask further improves the CPR effectiveness of the invention.

Accordingly, the present invention is directed to a system for enhancing blood flow to and from the heart during cardiopulmonary resuscitation of a patient, comprising a plurality of leg and body encircling bladders connected in pneumatic series from furthermost encircling bladders to innermost encircling bladders, and an air pressure regulator for pneumatically connecting to a pressurized air source, the air pressure regulator having an output pneumatically connected to the furthermost encircling bladders and being capable of automatically cycling, at a preselected cycling rate, the output air pressure between a lower preselected pressure and a higher preselected pressure, and wherein the lower preselected pressure is preselected to be sufficient to maintain peripheral vascular resistance in the body areas of the patient covered by the encircling bladders. The plurality of leg and body encircling bladders may comprise two calf-encircling bladder sections, each calf-encircling bladder section including a plurality of calf-encircling bladders connected in pneumatic series from a furthermost calf-encircling bladder to an innermost calf-encircling bladder, two thigh-encircling bladder sections, each thigh-encircling bladder section including a plurality of thigh-encircling bladders connected in pneumatic series from a furthermost thigh-encircling bladder to an innermost thigh-encircling bladder, wherein the furthermost thigh-encircling bladder of each thigh-encircling bladder section is connected in pneumatic series from the innermost calf-encircling bladder of a corresponding calf-encircling bladder section, and an abdomen-covering bladder section including at least one abdomen-covering bladder connected in pneumatic series from at least one of the innermost thigh-encircling bladders. The system may further comprise a pair of upper arm encircling bladders pneumatically connected to the output of the air pressure regulator. The abdomen-covering bladder section may include a plurality of abdomen-covering bladders connected in pneumatic series, wherein two of the abdomen-covering bladders are each connected in pneumatic series from corresponding uppermost thigh-encircling bladders. The air pressure regulator may include an input pneumatically connected to an output for the abdomen-covering bladder section. The system may further include a pulmonary face mask and a pneumatically connected second a second air pressure regulator for connecting to the pressurized air source. The lower preselected pressure and the higher preselected pressure may be preselected to be the same and to be sufficient to prevent hypovolemia in the patient.

The present invention is further directed to a method for enhancing blood flow to and from the heart during cardiopulmonary resuscitation of a patient, comprising peristaltically pumping blood headward from the legs and abdomen of the patient by cyclically inflating and deflating a plurality of leg and body encircling bladders connected in pneumatic series from furthermost encircling bladders to innermost encircling bladders, the inflation starting at the furthermost encircling bladders and flowing toward the innermost encircling bladders, wherein the cyclic inflation and deflation is between a preselected lower pressure and a preselected higher pressure, and wherein the lower preselected pressure is preselected to be sufficient to maintain peripheral vascular resistance in the body areas of the patient covered by the encircling bladders.

DESCRIPTION OF THE DRAWINGS

The present invention will be more clearly understood from a reading of the following detailed description in conjunction with the accompanying drawings wherein.

DETAILED DESCRIPTION

Figure 1:
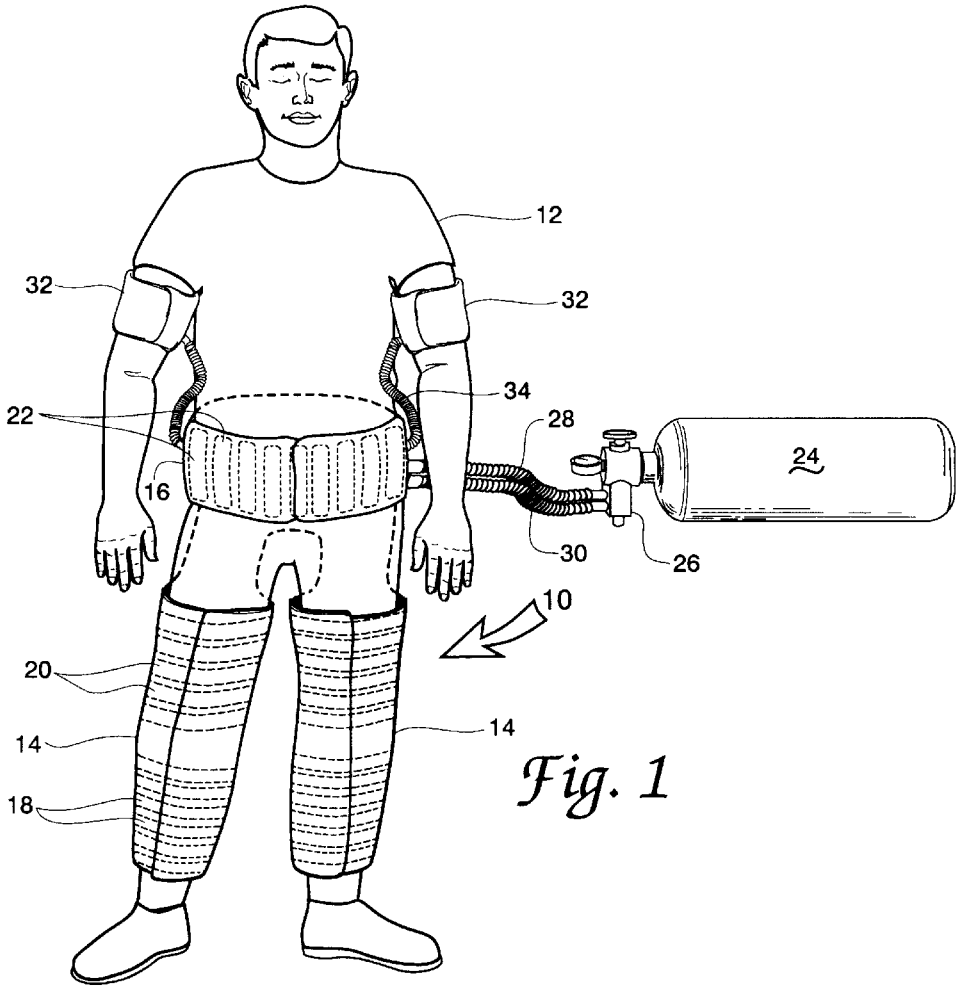
FIG. 1 is a perspective front view of a pair of autocycling retrograde inflation trousers made according to the teachings of the present invention showing the trousers in their wrapped configuration after being wrapped onto a patient.

Referring now to FIG. 1 of the drawings, there is shown a perspective view of a pair of autocycling retrograde inflation trousers 10 made according to the teachings of the present invention. Trousers 10 are shown in their wrapped configuration on an injured victim or patient 12. Trousers 10 include leg sections 14 and an abdominal section 16. Sewn inside each leg section 14 and inside abdominal section 16, similar to a blood pressure cuff, are calf bladders 18, thigh bladders 20 and abdominal bladders 22, shown in dashed outline in FIG. 1. Trousers 10 in this embodiment have large cutout sections to facilitate putting them onto an unconscious patient. A standard fire department 2,500 or 4,500 p.s.i. self-contained breathing apparatus air bottle 24 supplies pressurized air to trousers 10 through a pressure regulator 26. Hoses 28 and 30 are, respectively, an inlet and an optional outlet, or return line, for pressurized air to, and from, trousers 10. A pair of arm cuffs 32 are attached to trousers 10 by air hoses 34.

Figure 2:
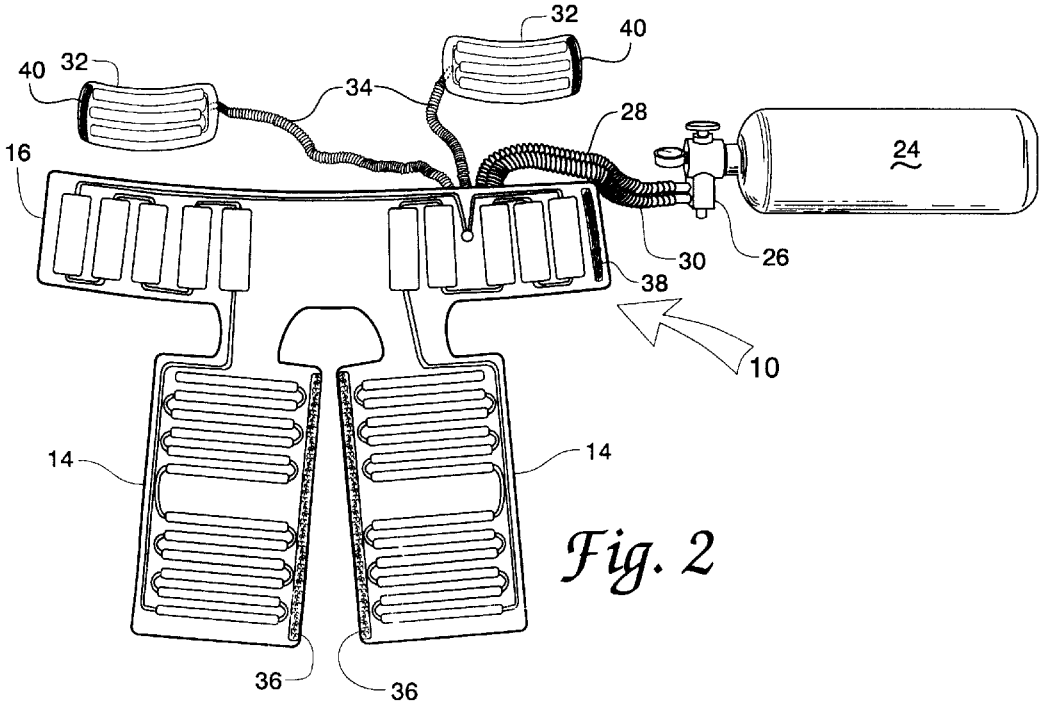
FIG. 2 is a perspective front view of the autocycling retrograde inflation trousers of FIG. 1 showing the trousers in their unwrapped configuration ready to be wrapped onto a patient.

FIG. 2 shows autocycling retrograde inflation trousers 10 in their unwrapped configuration ready to be placed onto patient 12. To put on patient 12, the patient is simply laid down on top of trousers 10 which are then wrapped over the legs and abdomen. In this embodiment, VELCRO®, or similar, hook strips 36, 38 and 40 are used to fasten and cinch trouser sections 14 and abdominal section 16 around the legs and torso of patient 12. As is shown by viewing FIGS. 1 and 2 together, calf bladders 18 and thigh bladders 20 completely encircle the calves and thighs of patient 12, while abdominal bladders 22 cover the front of the abdomen.

Figure 3:
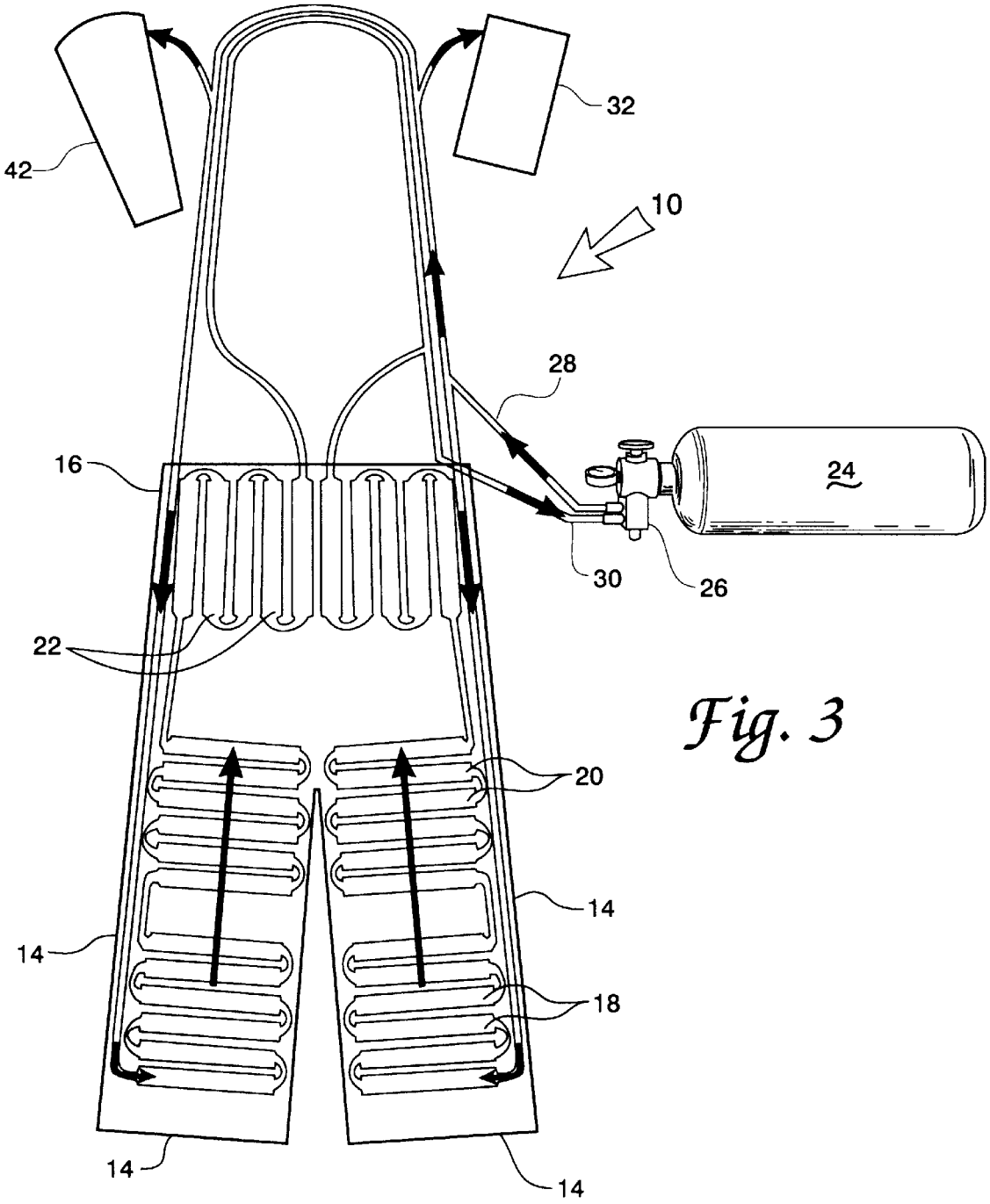
FIG. 3 is a schematic front view of the autocycling retrograde inflation trousers of FIG. 1; and, FIG. 4 is a perspective front view of the autocycling retrograde inflation trousers of FIG. 1 showing the addition of a pulmonary resuscitation face mask.

FIG. 3 is a schematic front view of autocycling retrograde inflation trousers 10 showing schematically the directions of flow of pressurized air. FIG. 3 also shows a schematic arm sleeve 42 which can optionally be used instead of an arm cuff. FIG. 3 shows bladders 18, 20 and 22 connected in pneumatic series from furthermost (farthest from the heart) bladders to innermost (closest to the heart) bladders.

Figure 4:
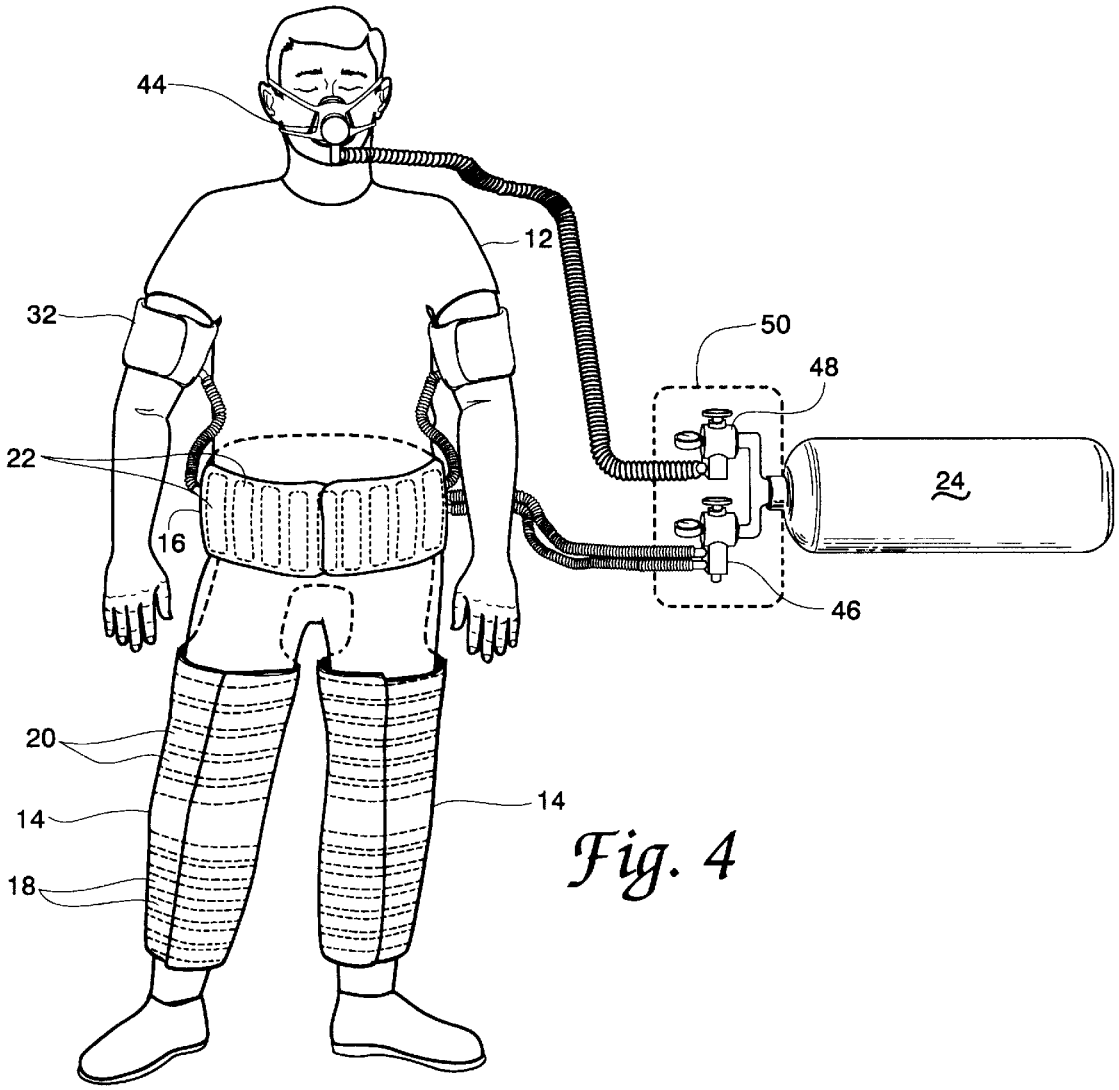

FIG. 4 is a perspective front view of autocycling retrograde inflation trousers 10 showing the addition of a pulmonary resuscitation face mask 44. In this embodiment, pressure regulator 26 is replaced by both an autocycling pressure regulator 46 and a conventional demand pulmonary resuscitation pressure valve 48, together identified by a surrounding dashed line as a combination pressure regulator 50. The combination of pulmonary inflation through face mask 44 and enhanced blood flow through trousers 10 will greatly increase overall CPR effectiveness. Preferably, five cycles of pressurizing retrograde inflation trousers 10 should be performed for each pulmonary inflation through mask 44. In this embodiment, after every five cycles of peristaltic pumping through trousers 10, autocycling pressure regulator 46 is manually stopped, leaving only a ready pressure for continued peripheral vascular resistance, and valve 48 is manually opened to apply pulmonary pressure through mask 44. Valve 48 is then closed and pressure regulator 46 reactivated for five more cycles.

Autocycling retrograde inflation trousers 10 are based on the anti-G suit design of David Clark and Earl Wood as disclosed in their U.S. Pat. No. 2,495,316. Clark and Wood taught that the desirable milking or peristaltic pumping effect discussed in the Background of the Invention can be achieved without complicated valving. By pneumatically connecting the air bladders in pneumatic series in a headward direction from the furthermost air bladders, and applying pressurized air starting with the furthermost pair of calf bladders 18, peristaltic pumping occurs automatically. Arm cuffs 32 and arm sleeve 42, also taught by Clark and Woods, are filled immediately to prevent blood perfusion into the arms as blood is pumped headward from the legs and abdomen.

For use as fully successful cardiopulmonary resuscitation trousers, the original Clark and Wood anti-G suit needs to be modified and additional features added. An obvious modification is to make the pressurized air supply autocycling. This can be accomplished with air pressure regulator 26. A not obvious modification is providing about 25 mm Hg of ready pressure in trousers 10 during the deflation phase of cardiovascular pumping to maintain peripheral vascular resistance in the lower torso and legs so that blood pooling in these areas is prevented. While ready pressure has been used in anti-G suits in the past, it was so that the suits would inflate more quickly after being triggered by the onset of high acceleration, and not for maintaining peripheral vascular resistance in healthy aircrew members.

When used for CPR, the autocycling rate, up to 80 cycles per minute depending on the age and size of the patient, will serve as a timing guide, like a metronome, for a paramedic or other health care worker applying artificial respiration and chest pressure.

Return line 28 is optional and allows more accurate control over pressure inside autocycling retrograde inflation trousers 10 by allowing the venting of pressurized air to be controlled by air pressure controller 26.

A more automatic version of combination pressure regulator 50 may be made by the following example. First, a suitable pressure regulator for the function performed by pressure regulator 26 may be understood as the pressure regulator originally taught by Clark and Wood with the acceleration sensing function replaced by an autocycling solenoid and related circuitry. Those of ordinary skill in the art will recognize that it would be a straightforward modification to such a pressure regulator to modify the solenoid circuitry to halt after a preselected number of pulse or pressure cycles, maintaining only a ready pressure, and then trigger the same or another solenoid to open a pneumatic path to a resuscitation face mask for a preselected period of time before closing that path and beginning another set of pressure cycles to the retrograde inflation trousers.

The primary use for the disclosed autocycling retrograde inflation trousers will be as part of first responder care for a heart attack victim who requires CPR. As previously described, the victim is placed on top of the retrograde inflation trousers, the trouser and abdomen sections wrapped around the legs and abdomen of the victim and cinched with VELCRO®, the air regulator set to cycle pressurized air between a lower ready pressure of 25 mm Hg and a higher pressure sufficient to force blood to flow headward at a sufficient rate. The health care worker performing CPR will perform chest compressions in synchrony with the inflation of the retrograde inflation trousers such that, as the trousers start to inflate, a chest compression is performed. If pulmonary resuscitation is needed, a pulmonary face mask can be made part of the system.

Those with skill in the art of the invention will readily see that the disclosed trousers can also be used for rehabilitative therapies, particularly therapies of benefit to paraplegic and quadriplegic patients. The therapeutic benefits include the prevention of edema formation in the legs secondary to prolonged blood pooling. Similarly, use of the disclosed trousers can help prevent the formation of blood clots in deep veins. This last use would typically require pressurizing the trousers to a constant 100 mm Hg pressure to prevent low blood pressure during movement from a wheelchair to another surface. Those with skill in the art of the invention will see that the ease of use and portability of the disclosed trousers make their use by health care personnel more likely than more complex prior art apparatus. Other therapeutic uses include for increasing venous and lymphatic flow, treating leg ulcers and to reduce swelling and enhance wound healing.

The disclosed autocycling retrograde inflation trousers successfully demonstrate the advantages of a simple apparatus for providing peristaltic pumping for cardiopulmonary resuscitation. Although the disclosed trousers are specialized, its teachings will find application in other areas where complicated mechanisms may be preventing their introduction and acceptance in the field.

Modifications to the invention as described may be made, as might occur to one with skill in the field of the invention, within the intended scope of the claims. Therefore, all embodiments contemplated have not been shown in complete detail. Other embodiments may be developed without departing from the spirit of the invention or from the scope of the claims.

We claim:

1. A system for enhancing blood flow to and from the heart during cardiopulmonary resuscitation of a patient, comprising:

(a) a plurality of leg and body encircling bladders connected in pneumatic series from encircling bladders furthermost from the heart to encircling bladders innermost toward the heart; and, (b) an air pressure regulator for pneumatically connecting to a pressurized air source, the air pressure regulator having an output pneumatically connected to the encircling bladders furthermost from the heart and being capable of automatically cycling, at a preselected cycling rate, the output air pressure between a lower preselected pressure and a higher preselected pressure, and wherein the lower preselected pressure is preselected to be sufficient to maintain peripheral vascular resistance in the body areas of the patient covered by the encircling bladders.

2. The system for enhancing blood flow to and from the heart according to claim 1, wherein:

(a) the plurality of leg and body encircling bladders comprise:

(i) two calf-encircling bladder sections; each calf-encircling bladder section including a plurality of calf-encircling bladders connected in pneumatic series from a calf-encircling bladder furthermost from the heart to a calf-encircling bladder innermost toward the heart;

(ii) two thigh-encircling bladder sections, each thigh-encircling bladder section including a plurality of thigh-encircling bladders connected in pneumatic series from a thigh-encircling bladder furthermost from the heart to an thigh-encircling bladder innermost toward the heart, wherein the furthermost thigh-encircling bladder of each thigh-encircling bladder section is connected in pneumatic series from the innermost calf-encircling bladder of a corresponding calf-encircling bladder section; and, (iii) an abdomen-covering bladder section including at least one abdomen-covering bladder connected in pneumatic series from at least one of the thigh-encircling bladders innermost toward the heart; and, (b) the output of the air pressure regulator is pneumatically connected to both of the calf-encircling bladders furthermost from the heart.

3. The system for enhancing blood flow according to claim 1, further comprising a pair of upper arm encircling bladders pneumatically connected to the output of the air pressure regulator.

4. The system for enhancing blood flow according to claim 2, wherein the abdomen-covering bladder section includes a plurality of abdomen-covering bladders connected in pneumatic series, wherein two of the abdomen-covering bladders are each connected in pneumatic series from corresponding thigh-encircling bladders innermost toward the heart.

5. The system for enhancing blood flow according to claim 2, wherein the air pressure regulator includes an input and the abdomen-covering bladder section includes an output, wherein the air pressure regulator input is pneumatically connected to the abdomen-covering bladder section output.

6. The system for enhancing blood flow according to claim 1, further comprising:

(a) a pulmonary face mask; and, (b) pneumatically connected to the pulmonary face mask, a second air pressure regulator for connecting to the pressurized air source.

7. The system for enhancing blood flow according to claim 2, further comprising:

(a) a pulmonary face mask; and, (b) pneumatically connected to the pulmonary face mask, a second air pressure regulator for connecting to the pressurized air source.

8. A method for enhancing blood flow to and from the heart during cardiopulmonary resuscitation of a patient, comprising peristaltically pumping blood headward from the legs and abdomen of the patient by cyclically inflating and deflating a plurality of leg and body encircling bladders connected in pneumatic series from encircling bladders furthermost from the heart to encircling bladders innermost toward the heart, the inflation starting at the encircling bladders furthermost from the heart and flowing headward toward the encircling bladders innermost toward the heart, wherein the cyclic inflation and deflation is between a preselected lower pressure and a preselected higher pressure, and wherein the lower preselected pressure is preselected to be sufficient to maintain peripheral vascular resistance in the body areas of the patient covered by the encircling bladders.

* * * * *